US006287093B1

(12) United States Patent
Huebel et al.

(10) Patent No.: US 6,287,093 B1
(45) Date of Patent: Sep. 11, 2001

(54) SIDE CANAL PUMP WITH A SIDE CANAL LOCATED IN THE SUCTION COVER IN ORDER TO AVOID IMPERFECT VORTEX STRUCTURES

(75) Inventors: Michael Huebel, Gerlingen (DE); Willi Strohl, Anderson, SC (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/367,121

(22) PCT Filed: Sep. 23, 1998

(86) PCT No.: PCT/DE98/02819

§ 371 Date: Aug. 6, 1999

§ 102(e) Date: Aug. 6, 1999

(87) PCT Pub. No.: WO99/34117

PCT Pub. Date: Jul. 8, 1999

(30) Foreign Application Priority Data

Dec. 23, 1997 (DE) ..... 197 57 580

(51) Int. Cl.[7] ..... F04B 17/00; F01D 1/12

(52) U.S. Cl. ..... 417/423.14; 415/52.1

(58) Field of Search ..... 417/423.14, 423.12, 417/423.1, 321; 415/52.1, 55.1

(56) References Cited

U.S. PATENT DOCUMENTS 4,591,311 * 5/1986 Matsuda et al. ..... 415/55.5
4,653,979 * 3/1987 Schillinger ..... 415/55.6
4,804,313 * 2/1989 Nasvytis ..... 415/55.1
5,149,252 * 9/1992 Tuckey et al. ..... 417/205
5,284,417 * 2/1994 Yu ..... 415/55.1
5,336,045 * 8/1994 Koyama et al. ..... 415/55.1
5,551,835 * 9/1996 Yu et al. ..... 415/55.1
5,551,842 * 9/1996 Schmid et al. ..... 417/203
5,558,490 * 9/1996 Dobler et al. ..... 415/55.1
5,599,163 * 2/1997 Heath et al. ..... 415/55.1
5,904,468 * 5/1999 Dobler et al. ..... 415/55.2
6,095,771 * 8/2000 Schelhas et al. ..... 417/423.14

FOREIGN PATENT DOCUMENTS 195 04 079 A1 8/1996 (DE) .

* cited by examiner

*Primary Examiner*—Teresa Walberg
*Assistant Examiner*—Daniel Robinson
(74) *Attorney, Agent, or Firm*—Michael J. Striker

(57) ABSTRACT

The invention relates to a side-channel pump having an intake cover (10), which is used in pumping fuel in a motor vehicle. The intake cover (10) has a side channel (11), extending radially about a pivot point (14) in the intake cover (10), a first opening (13) for an intake channel (27) of the side channel (11) and a constant side channel width ($B_{SK}$) in a portion extending circumferentially. The side channel (11) has a side channel width ($B_{SK}$) in the top side (8) that is constant, as seen from a beginning (12) of the side channel (11), already at a value of a first angle (ϕ) of between 0 and preferably approximately 5 and at most 20 , referred to a line ($L_B$) through the pivot axis (14) and through a contact point (1) at the beginning (12). This makes for better hot-gasoline performance, increased efficiency, and a higher pressure ratio of the side-channel pump. The intake cover is suitable in particular for a dual-flow side-channel pump.

20 Claims, 2 Drawing Sheets

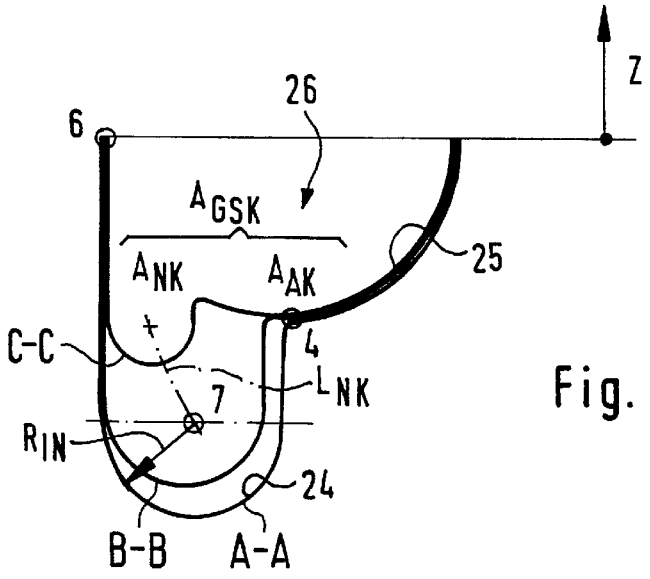
Fig. 2
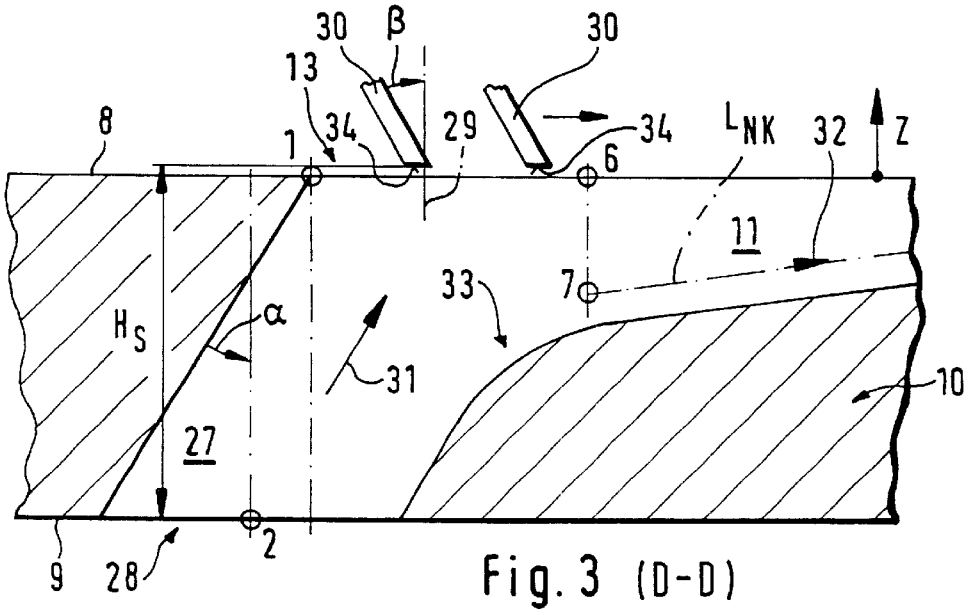
Fig. 3 (D-D)

SIDE CANAL PUMP WITH A SIDE CANAL LOCATED IN THE SUCTION COVER IN ORDER TO AVOID IMPERFECT VORTEX STRUCTURES

BACKGROUND OF THE INVENTION

The present invention is based on a side-channel pump having an intake cover for a side-channel pump, which is used in pumping fuel in a motor vehicle. The intake cover has a side channel, extending radially around a pivot axis in the intake cover, and also has a top side and an underside and a first opening in the underside for an intake channel of the side channel. The fluid flowing through the side-channel pump flows via the intake channel through the side channel to an outlet from the side channel.

One intake cover and one design of a side-channel pump are known from German Patent Disclosure DE 195 04 079 A1. An axially extending intake channel discharges into a side channel that extends in the cover, in which side channel, as a result of pulse exchange events with a bladed rotor about its pivot axis, a pressure buildup takes place as far as the outlet neck. The blading of the rotor is placed obliquely relative to the pivot axis in such a way that toward one face end of the rotor it is leading in the circumferential direction of the rotor.

German Patent Disclosure DE43 43 078 A1 in turn describes a unit for pumping fuel by means of a side-channel pump. A side channel in an intake cover of the side-channel pump has a cross-sectional reduction by the factor of 0.5, in order to act as a compression channel. This cross-sectional reduction extends over an angular range of approximately 90 to 130 , referred to a beginning of the side channel; if there is a linear reduction in the cross section, then there is a transition via a small step to the remaining constant side channel cross section. A progressive cross-sectional reduction contemplated there has a continuous reduction in the side channel depth and side channel width without any step. The cross-sectional reduction is than attained via a reduction in the side channel depth and a progressive reduction, for instance, in the side channel width over the angular range of 90 to 130.

SUMMARY OF THE INVENTION

It is therefore an object of the present invention to provide a side-channel pump which avoids the disadvantages of the prior art.

In keeping with these objects, one feature of present invention resides, briefly stated, in a side-channel pump, in which the side channel width in the top side over an angular range having a first angle referred to the reference line of 0 and 20 is constant as far as an outlet from the side channel.

The side-channel pump with an intake cover, as defined by the invention, has the advantage over the known prior art that the pump efficiency and hot gasoline performance are improved. To that end, the side channel has a constant side channel width in the top side in the top side in an angular range having a first angle $\phi$ referred to a reference line, that extends through the pivot axis and through a contact point at the beginning of the side channel, of 0 , preferably approximately 5 , and at most 20 as far as the outlet from the side channel. Previously, the attempt had been made to avoid the formation of turbulence structures that cause loss and an unintended separation of the flow in the side channel by narrowing the side channel width steadily down to a constant value over a wide angular range. The proposed geometry, conversely, attains a higher suction level, for instance, because even at least in the immediate vicinity of the beginning of the side channel, the side channel has the most constant possible width. The constant channel width, which as a result is disposed near the first opening for the intake channel, assures that in the region of an inlet flow of fuel into the side channel, a development of braids of turbulence in the flow is avoided. Hydraulic losses and local negative pressure zones, which could otherwise lessen the efficiency or, because of an increased vapor pressure in the case of hot gasoline in the summer could cause the danger of cavitation and thus blockage of the blade cross section, are decisively reduced.

It is also possible, because of the constant width of the side channel, that upon the inflow of fuel through the intake channel, a development of a detachment bubble, from the high suction occurring in an outer region of the inflowing fuel in the case of a dual-flow side-channel pump, toward a pumping step located opposite the intake channel, is suppressed.

One advantageous refinement provides that the side channel has a center line whose radius to the pivot axis remains constant, at the latest beyond the first angle $\phi$=15 . The center line is the line in the side channel that results when each width of the side channel is divided in half. The side channel as a result already extends circumferentially at the intake channel without the imposition of an additional radial flow direction on the flow as would be the case if the center line radius were not constant. As a result, an inlet flow pointing radially inward toward the pivot axis between the intake channel and the side channel is averted. It is therefore advantageous for the center line radius to already be constant at $\phi$=0.

It is also preferred that the side channel have a constant width in the top side no later than beyond the first angle $\phi$=5. The side channel width is located in the face of the top side of the intake cover that has the side channel which is open at the top. Below the top, or in other words between the top and the underside, the side channel in one version has a greater side channel width. However, this width preferably also drops, within at most $\phi$=20 to 30 of the first angle, to the constant side channel width in the top side. In this way, by a kind of funnel effect, a pressure buildup is again made possible, which has a favorable effect on the inflow of the opposed pumping step of a dual-flow side-channel pump. In a further feature, this effect is reinforced by a transition from the first opening into the side channel via the intake channel. The intake channel below the plane through the top side has an increasingly slender transition that conforms to the side channel. This transition can already begin at the first, preferably round opening. Below the underside, the side channel and the intake channel with its transition therefore still have a greater width than in the topside. This kind of favorable flow course is further promoted by the fact that the first opening for the intake channel of the side channel, as well as the intake channel itself and the transition to the side channel, are designed to be as circular as possible.

It has proved to be a further advantage if an outer region of the beginning of the side channel, with the most constant possible width, has an initial radius $R_A$ relative to a side channel radius $R_{SK}$ of approximate $R_A$=0.4 $R_{SK}$ to $R_A$=1.1 $R_{SK}$. The side channel radius $R_{SK}$ is defined as the radius which maximally determines the geometry of the side channel in the angular range of constant side channel width. This will be seen in more detail below from the drawing. A separation flow in the region of the beginning of the side channel is averted by this kind of initial radius $R_A$. At the same time, this makes for a smooth transition of the inlet flow into the side channel, so that there is no disturbance to circulation with the attendant hydraulic losses. A further advantage of such a radius is that reverse flows are prevented. In that case, a blade chamber inflow into the blading of the side-channel pump is then unimpeded by collisions.

A development of turbulence braids in the inlet flow through the intake channel at the transition to the side channel is also averted by the provision that the first center point of the first opening is located radially closer to the dx than the center line along the side channel. Not only hydraulic but even local negative pressure zones are thus prevented, with the advantageous effects described above with regard to hot gasoline. A reduction in collision losses in the blade chamber inflow is also reinforced in cooperation with the first opening, located radially closer to the pivot axis, by the fact that the first center point of the first opening is offset, by a second angle $\phi_2$ of −5 to +15 about the pivot axis relative to the reference line through the beginning of the side channel, counter to a direction along the side channel. With the oblique blading of the rotor which is preferably employed, this makes for a uniform inflow of fuel into the blade chambers, because the axial and tangential speed components are more favorable.

An especially advantageous feature of the intake cover has an additional inner groove as a groove channel in the side channel. The groove channel provides a continuous flow cross-section at the transition between the intake channel and the side channel. This is expressed in a uniform pressure buildup. The groove channel also enables a rapid and certain dissipation of any gas bubbles that may be present into a downstream degassing bore. A refinement of the groove channel provides that it tapers radially inward toward the pivot axis along an angular range $\phi_+$ about the pivot axis. Preferably, the angle $\phi$ for the range $\phi_+$ is approximately a value between 15 and 120 , and preferably 25 to 110 . This assures on the one hand that a calm, uniform transition of the groove channel in the side channel is assured. On the other, the pressure buildup is also made uniform by a uniform tapering. The side channel can therefore be divided in this region along a width into one region of the groove channel and another region, which is the outer channel.

To make the flow uniform, the groove channel has a depth which is greater than that of the outer channel. For a steady transition and a uniform pressure buildup, it is advantageous that the depth of the groove channel decreases steadily. The development of turbulence from transition between flows of different radial, tangential or axial flow speeds is maximally averted. Especially in cooperation with the revolving blade inlet edges of the blading, this steady transition leads to a decrease in collision losses that would otherwise possibly occur. Making the fuel flow uniform in this way is attained in particular by providing that a first groove bottom of the groove channel changes over into a second groove bottom of the outer channel, and the two form a common, homogeneous groove bottom of the side channel. These groove bottoms that merge gently with one another enable compression without the hindering development of turbulence. On the contrary, any circulatory flow that has built up and is intended in the side channel is brought to a developed state without hindrance in this way, while reverse flows that involve loss are prevented. The buildup of the circulatory flow is furthermore reinforced still further in that a beginning of the groove channel, in the region of the inflow of fuel through the intake channel, has rounded transitions.

An advantageous disposition of the groove channel in the side channel provides that a radially inner boundary wall of the side channel is a wall of the groove channel. As a result, an equalization of the different speed components of the fuel flow flowing out of the intake channel into the side channel is attained. At the same time, entrained gas bubbles in this arrangement collect in the groove channel. The disposition of a degassing bore about a third angle $\phi_*$ of approximately 5 to 30 about the pivot axis relative to a tapered end of the groove channel in the side channel in the extension of the tapered end assures a rapid an reliable dissipation of the gas bubbles into the degassing bore.

In accordance with a further advantageous concept of the invention, which in particular can also be realized in independent form, the intake channel discharges obliquely into the first opening and into the side channel. This enables a radial inflow of fuel to the blading, which given the addition of the vectorial speed components relative to the blading of the revolving rotor achieves a considerable reduction in hydraulic losses compared with a purely axial intake channel. The reduction in hydraulic losses is reinforced by the fact that the first opening has an opening radius $R_S$ which is greater than the side channel radius $R_{SK}$ by a factor of approximately between 1.75 and 3.5. The opening radius $R_S$ is ascertained, given an approximately circular first opening, by abstracting a middle circle out of the contour of the first opening. The side channel radius $R_{SK}$ is ascertained in a similar way; it must be taken into account that the side channel has the side channel radius $R_{SK}$ at the groove bottom. It has been found that the above-described advantages can be amplified decisively still further in a side-channel pump. The blade inlet edge and the first opening on the underside, as an entrance for the fuel into the intake channel, have a spacing $H_S$, which is greater by a factor of approximately between 1.25 and 2.5 than the side channel radius $R_{SK}$. This makes the inlet flow uniform in the intake channel, and the transition to the blading is effected in sliding fashion without any abrupt collision that would otherwise cause the development of turbulence.

In particular, the intake cover is suitable for a dual-flow side-channel pump. To that end, the intake cover with the side-channel pump has an open side channel inflow cross section in the region of the beginning of the side channel for flooding a pumping step located opposite the intake channel. The open side channel inflow cross section is preferably located in a region that is disposed between the first angle of approximately 5 to +40 about the pivot axis. The region can also be described by means of a first, third and fourth reference point, as seen from the accompanying drawing.

DRAWING

One exemplary embodiment of the invention is shown in detail in the accompanying drawing and explained in the associated description, in which further advantageous features and characteristics are described.

FIG. 2 shows three sections A—A, B—B and C—C along a width of the side channel of FIG. 1; and FIG. 3 is a sectional view taken along the line D—D through the first opening and through the side channel of FIG. 1.

EXEMPLARY EMBODIMENT

Figure 1:
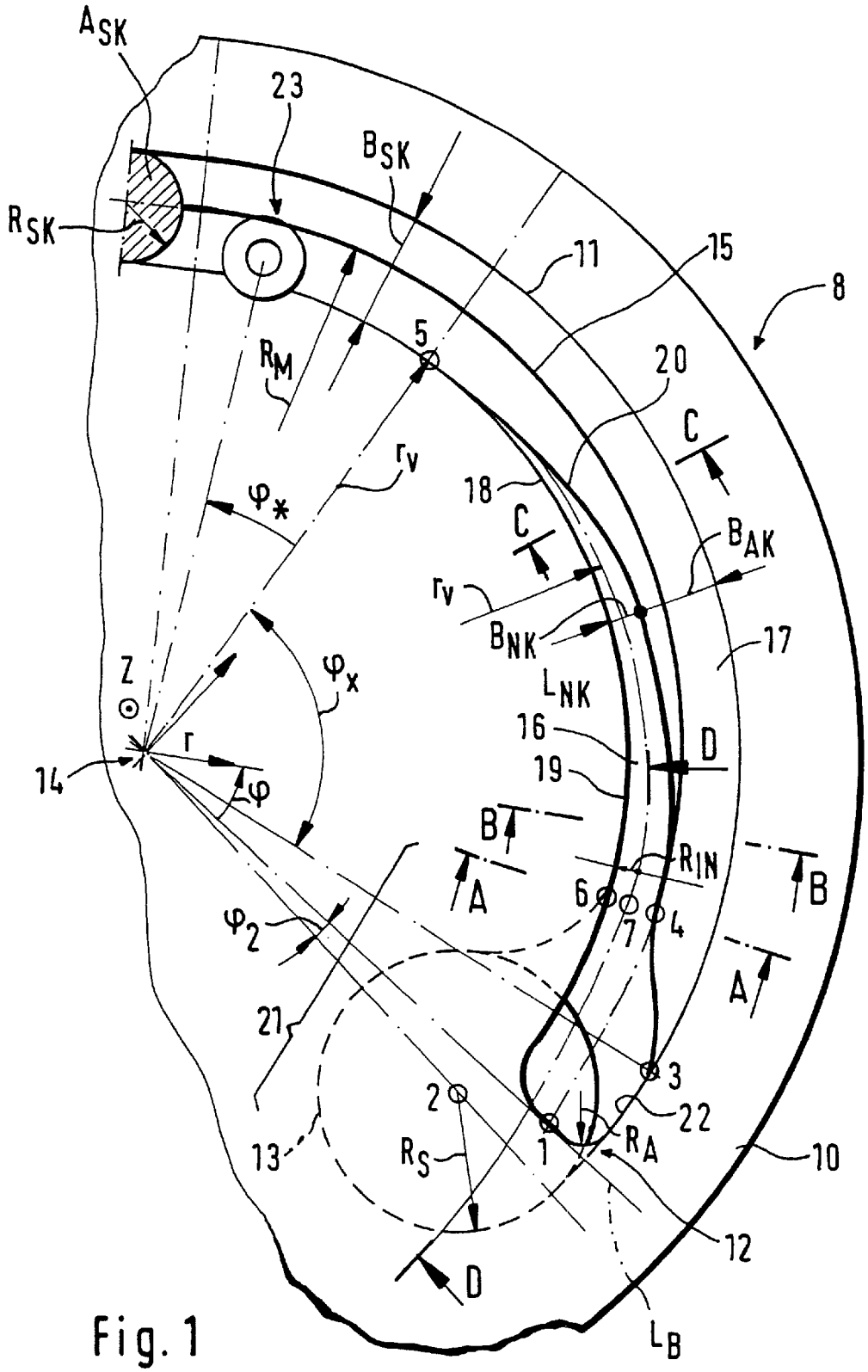
FIG. 1 shows a schematic plan view of a side channel in an intake cover with a round first opening.

FIG. 1 shows a detail of an intake cover 10 in a plan view on a top side 8. On the side opposite the topside 8, the intake cover 10 has an underside 9, not visible in this view. The view shows a side channel 11. The side channel 11 has a beginning 12, which is disposed in a region at a first opening 13. Disposed in the beginning 12 is a first reference point 1, as a contact point, which as a starting point with a pivot point 14 defines a reference line $L_B$ for a cylinder coordinate system r-ϕ-z. The contour of the first opening 13, which is partly not visible in this view, is suggested by dashed lines. Through the first opening 13, in operation of the side-channel pump, the fuel flows through and into a side channel, not visible in detail in this view. The first opening 13 in this exemplary embodiment is a circle with an opening radius $R_S$, whose first center coincides with a second reference point 2. The side channel 11, which as it were extends out of the first opening 13 via the intake channel, is disposed in a circular arc about the pivot point 14. A pivot axis for a blading, not shown, of the side-channel pump therefore also extends through the pivot point 14. Also extending through the pivot point 14, perpendicular to the top side 8, is a z-coordinate axis of the cylinder coordinate system. The z-coordinate axis in this exemplary embodiment is coincident with the pivot axis of the blading. A center line 15 of the side channel 11 has a center line radius $R_M$ relative to the pivot point 14. The center line 15 of the side channel 11 in this case corresponds to one-half of a side channel width $B_{SK}$ of the side channel 11. In this exemplary embodiment of the intake cover 10, half the side channel width $B_{SK}$ is identical to a side channel radius $R_{SK}$ of the side channel, which in the intake cover 10 defines an end cross section $A_{SK}$ of the side channel 11. The width $B_{SK}$ of the side channel is divided along the first angle ϕ into a groove channel width $B_{NK}$ of a groove channel 16 and an outer channel width $B_{AK}$ of an outer channel 17. While the side channel width $B_{SK}$ remains constant over the first angle ϕ, the groove channel width $B_{NK}$ varies, because it tapers downstream continuously along an angular range $\phi_+$ until a tapered end, which is identified as a fifth reference point 5. There, a first boundary wall 18 of the side channel 11, which is at the same time a first boundary wall 19 of the groove channel 16, coincides with a second boundary wall 20 of the groove channel 16.

For further description of the geometry of the side channel 11, first opening 13 and groove channel 16 in the intake cover 10, the reference points 1 through 7 will now be described, unless they have already been listed. Their coordinates are defined among other things as a function of the side channel radius $R_{SK}$, center line radius $R_M$ along the side channel 11, and the opening radius of the first opening $R_S$. The thus-defined coordinates of the individual reference points 1 through 7 are preferred for this particular application but can also deviate from this given a somewhat different geometry. In any case, it has proved to be advantageous if the opening radius $R_S$ is greater by a factor of between 2 and 3 than the side channel radius $R_{SK}$.

Reference Point r Coordinate Coordinate z Coordinate

| Reference Point | r Coordinate | Coordinate | z Coordinate |
|---|---|---|---|
| 1 | $R_M$ | 0 | 0 |
| 2 | $R_M + R_{SK} - R_S$ | −15° . . . +5° | −(1.5 . . . 2.5 $R_S$) |
| 3 | $R_M + R_{SK}$ | 7.5° . . . 15° | 0 |
| 4 | $R_M$ | 15° . . . 30° | $-R_{SK}$ |
| 5 | $R_M - R_{SK}$ | 90° . . . 120° | 0 |
| 6 | $R_M - R_{SK}$ | 15° . . . 30° | 0 |
| 7 | $R_M - 0.5\ R_{SK}$ | 15° . . . 30° | −(1.5 . . . 2 $R_{SK}$) |

The coordinates of reference points 1 through 7 refer not only to FIG. 1 but also to the coordinates of FIG. 2 and FIG. 3.

FIG. 1 shows that the beginning 12 of the side channel 11, the side channel has a constant width $B_{SK}$ at reference point 1. In a preferred application of the intake cover 10 in a dual-flow side-channel pump, an inflow region 21 is designed such that the respective pump flows for flooding both pumping steps of the dual-flow side-channel pump are maximally decoupled from one another. Flooding of the pumping step, not identified by reference numeral here, remote from the first opening 13 is effected in a region between the reference points 1, 3 and 4. To that end, to avoid throttle losses, an inflow cross section, not shown here, to blade chambers not shown in FIG. 1 is designed to be open up to a second boundary wall 22 of the side channel 11. In this case, this open inflow cross section extends over an angular range of the first angle through the first reference point 1 as far as the third reference point 3. As a result, throttling upon flooding of the opposed pumping step in the event of an overflow of the fuel is averted. An avoidance of the throttling losses is additionally reinforced by providing an initial radius $R_A$ at the beginning 12 of the side channel 11 whose size is a factor of between 0.4 to 1.1 of the side channel radius $R_{SK}$ and by recessing the second reference point 2, as the center point of the first opening 13 by a second angle $\phi_2$. The second reference point 2 is furthermore located much closer to the pivot axis 14 than is the first reference point 1 corresponding to the beginning 12 of the side channel 11. The side channel width $B_{SK}$ is less than the opening radius $R_S$.

The circulatory flow necessary to increase the pressure is initiated by providing that beyond reference point 3, the side channel 11 with the side channel radius $R_{SK}$ is made continuously up to reference point 4 in order to embody a groove bottom, to be described in further detail below, of the side channel 11. The aforementioned groove channel 16 in turn enables a continuous cross-sectional course of the inflow of fuel from the first opening 13 to the end cross section $A_{SK}$ at reference point 5 of the side channel 11. The end cross section $A_{SK}$ is shown shaded, using the side channel radius $R_{SK}$. The geometry of the groove channel 16 is defined largely on the one hand via an inner radius $R_{IN}$ and on the other via a taper radius $r_v$, which varies along an angular range $\phi_+$ along half the groove channel width $B_{NK}$ from the pivot point 14. The tapering radius $r_v$ preferably extends linearly along a reference line $L_{NK}$ in the middle of the groove channel between reference point 7 and reference point 5 along a z-projection plane, in accordance with the function $$r_V = \frac{r_5 - r_7}{\phi_5 - \phi_7}(\phi - \phi_7) + r_7$$

The inner radius $R_{IN}$ of the groove channel 16 is preferably selected as $R_{IN}=r_v-(R_M-R_{SK})$. The realization of the continuous cross-sectional course in the transition region between the first opening 13 and the side channel 11 by means of the groove channel 16 leads to a uniform pressure buildup as well as to a fast, reliable dissipation of gas bubbles into a down stream degassing bore 23. The degassing bore 23 is disposed away from the tapered end 5 by a third angle $\phi_*$ of approximately 5 to 30, and as shown the degassing bore 23 extends downstream of the groove channel 16 and in the inner region of the side channel 11.

FIG. 2 shows three sections along the lines A—A, B—B and C—C of FIG. 1. The inner radius $R_{IN}$ is defined such that a total side channel cross section $A_{GSK}$ composed of a channel groove cross section $A_{NK}$ and an outer channel cross section $A_{AK}$ in the line A—A through the fourth reference point 4, sixth reference point 6 and seventh reference point 7 is greater by a factor of approximately 2 than the end cross section $A_{SK}$ of the side channel 11 of FIG. 1. As can be seen from the sections B—B and C—C, the side channel cross section decreases along the first angle $\phi$. This is preferably effected virtually linearly or slightly progressively; the end cross section $A_{SK}$ of the side channel 11 is reached at approximately the fifth reference point 5 in FIG. 1. By means of this kind of tapering groove design, it is assured on the one hand that the outer channel 17 that has been made extends continuously inward, and thus the circulatory flow built up is not substantially impeded. Second, gas bubbles can quickly be broken down by the decreasing groove channel cross section $A_{NK}$ and quickly carried away to the degassing bore 23. In addition, a reverse flow that causes losses is averted. A steady transition from a first groove bottom 24 of the groove channel 16 to a second groove bottom 25 of the outer channel 17 for forming a common, homogeneous third groove bottom 26 of the side channel 11, as shown in the three sections disposed one after the other in FIG. 2, reinforces the avoidance of flow losses. This transition is indicated by the dashed reference line $L_{NK}$, along which the inner radius $R_{IN}$ of the groove channel 16 migrates steadily.

FIG. 3 shows a section along the sectional plane D—D in FIG. 1. An intake channel 27 discharges into the first opening 13; the intake channel 27 is oriented obliquely to the axially extending pivot axis 29 of the rotor blades 30. The first opening 13 forms an inlet 28 for the fuel flowing into the side channel 11, as indicated by the arrow 31. The fuel flows obliquely to the rotor blades 30, which means an oncoming flow with less impact and thus means a reduction in losses. An inclination of the intake channel 27 to the pivot axis 29 is in particular so marked that the second reference point 2 relative to the beginning of the side channel, marked by the first reference point 1, is recessed relative to the second angle $\phi_2$ from FIG. 1. This oblique inflow on the part of the fuel 31 is expediently exploited by the use of rotor blades 30 that are also inclined by an angle $\beta$, adapted thereto, relative to the pivot axis 29. As already suggested by a course 32 along the reference line $L_{NK}$ of the varying outset position of the inner radius $R_{IN}$ through the reference point 7, a steady transition of the geometries for the inflowing fuel 31 is also attained by means of rounded transitions 33. The geometry of the intake cover 10 is also especially well suited for a dual-flood side-channel machine, not identified by reference numeral, with an unthrottled overflow performance at a parting rib between the blade chambers disposed opposite one another. It is preferred if a spacing $H_S$ between the inlet 28 into the intake channel 27 and an inlet edge 34 of the blade has a value that is greater by a factor of approximately 1.3 to 2.8 than the opening radius $R_S$ of the first opening 13. With this kind of dimensioning, collision losses upon the inflow of fuel 31 are extremely slight.

What is claimed is:

1. A side-channel pump for fuel pumping in a motor vehicle, having an intake cover (10) with a top side (8) and an underside (9), a tapering side channel (11), open on the top side (9) and extending circumferentially about a pivot point (14) of the side-channel pump, a first opening (13) in the underside (9) for an intake channel (27) of the side channel (11), the intake channel (27) extending from the underside (9) to the top side (8), and a side channel width ($B_{sk}$) that is constant at least in the top side (8), at least in a portion extending circumferentially, and a reference line ($L_B$) extends through the pivot axis (14) and through a contact point (1) at the beginning (12) of the side channel (11), the side channel width ($B_{sk}$) in the top side (8), over an angular range having a first angle ($\phi$), referred to the reference line ($L_B$), of 0 and 20, is constant as far as an outlet from the side channel (11), and additional internal groove in the form of a groove channel (16) assigned to said side channel (11).

2. The side-channel pump of claim 1, wherein the side channel (11) has a center line (15), whose center line radius ($R_M$) from the pivot axis (14) remains the same at least beyond the first angle ( ) of approximately 15.

3. The side-channel pump of claim 1, wherein the side channel (11), at least beyond the first angle ($\phi$) where $\phi$=5 in the top side (8) has a constant side channel width ($B_{SK}$), while below the top side (8), the side channel width ($B_{SK}$) of the side channel (11) is even greater.

4. The side-channel pump of claim 3, wherein below the top side (8), the side channel width ($B_{SK}$), within the first angle ($\phi$) of at most =30, tapers down to the constant side channel width ($B_{SK}$) in the top side (8).

5. The side-channel pump of claim 1, wherein the beginning (12) of the side channel (11) in an outer region has an initial radius ($R_A$) relative to a side channel radius ($R_{SK}$) of approximately $R_A$=0.4 $R_{SK}$ to $R_A$=1.1 $R_{SK}$.

6. The side-channel pump of claim 1, wherein a first center point (2) of the first opening (13) is offset by a second angle ($\phi_2$) of −5 to +15 about the pivot axis (14) relative to the beginning (12) of the side channel (11), counter to a direction along the side channel (11).

7. The side-channel pump of claim 1, wherein an intake channel (27) discharges obliquely into the side channel (11).

8. A side-channel pump for fuel pumping in a motor vehicle, having an intake cover (10) with a top side (8) and an underside (9), a tapering side channel (11), open on the top side (9) and extending circumferentially about a pivot point (14) of the side-channel pump, a first opening (13) in the underside (9) for an intake channel (27) of the side channel (11), the intake channel (27) extending from the underside (9) to the top side (8), and a side channel width ($B_{sk}$) that is constant at least in the top side (8), at least in a portion extending circumferentially, and a reference line ($L_B$) extends through the pivot axis (14) and through a contact point (1) at the beginning (12) of the side channel (11), the side channel width ($B_{sk}$) in the top side (8), over an angular range having a first angle ($\psi$), referred to the reference line ($L_B$), of 0 and 20, is constant as far as an outlet from the side channel (11), the side channel (11) has an additional internal groove in the form of a groove channel (16).

9. The side-channel pump of claim 8, wherein the groove channel (16) tapers radially inward around the pivot point (14).

10. The side-channel pump of claim 9, wherein the groove channel (16) tapers along an angular range ($_+$) about the pivot point (14) having the first angle ($\phi$) of approximately or equal to 15 to 120, preferably 25 to 110.

11. The side-channel pump of claim 8, wherein the groove channel (16) has a depth which is greater than that of an outer channel (17) of the side channel 11.

12. The side-channel pump of claim 8, wherein the depth of the groove channel (16) increases steadily.

13. The side-channel pump of claim 8, wherein a first groove bottom (24) of the groove channel (16) changes over into a second groove bottom (25) of the outer channel (17), and the two form a common, homogeneous third groove bottom (26) of the side channel (11).

14. The side-channel pump of claim 8, wherein a radially inward-located boundary wall of the side channel (11) is a wall of the groove channel (16).

15. The side-channel pump of claim 8, wherein a degassing bore (23) is disposed at a third angle ($\phi_*$) of approximately 5 to 30 about the pivot point (14) in reference to a tapering end (5) of the groove channel (16) in the side channel (11) in the extension of the tapered end (5).

16. The side-channel pump of claim 1, wherein the first opening (13) has an opening radius ($R_S$), which is greater by a factor of approximately between 1.75 and 3.5 than the side channel radius ($R_{SK}$).

17. The side-channel pump of claim 1, wherein a spacing ($H_S$) between a blade inlet edge (23) and an inlet (28) for the fuel (31) into the intake channel (27) is greater by a factor of approximately 1.25 and 2.5 than the side channel radius ($R_{SK}$).

18. The side-channel pump of claim 1, wherein as a dual-flow side-channel pump, it has an open side channel inflow cross section in a region between the first reference point (1), the third reference point (3), and the fourth reference point (4), for flooding a pumping step located opposite the intake channel (27).

19. An intake cover (10) for a side-channel pump having an embodiment according to claim 1.

20. A side-channel pump for fuel pumping in a motor vehicle, having an intake cover (10) with a top side (8) and an underside (9), a tapering side channel (11), open on the top side (9) and extending circumferentially about a pivot point (14) of the side-channel pump, a first opening (13) in the underside (9) for an intake channel (27) of the side channel (11), the intake channel (27) extending from the underside (9) to the top side (8), and a side channel width ($B_{sk}$) that is constant at least in the top side (8), at least in a portion extending circumferentially, and a reference line ($L_B$) extends through the pivot axis (14) and through a contact point (1) at the beginning (12) of the side channel (11), the side channel width ($B_{sk}$) in the top side (8), over an angular range having a first angle ($\psi$), referred to the reference line ($L_B$), of 5 and at most 20, is constant as far as an outlet from the side channel (11), the side channel (11) has an additional internal groove in the form of a groove channel (16).

* * * * *